US008210662B2

(12) United States Patent
Miyazawa et al.

(10) Patent No.: US 8,210,662 B2
(45) Date of Patent: Jul. 3, 2012

(54) LIQUID-EJECTING HEAD, LIQUID-EJECTING APPARATUS AND ACTUATOR DEVICE

(75) Inventors: Hiromu Miyazawa, Azumino (JP); Hiroshi Ito, Suwa (JP); Koichi Morozumi, Shiojiri (JP); Jiro Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 327 days.

(21) Appl. No.: 12/576,994

(22) Filed: Oct. 9, 2009

(65) Prior Publication Data

US 2010/0091075 A1 Apr. 15, 2010

(30) Foreign Application Priority Data

Oct. 10, 2008 (JP) ..... 2008-264651

(51) Int. Cl.
*B41J 2/45* (2006.01)

(52) U.S. Cl. ..... 347/72

(58) Field of Classification Search ..... 347/72
See application file for complete search history.

(56) References Cited

U.S. PATENT DOCUMENTS

| | | | | |
|---|---|---|---|---|
| 7,514,854 | B2 | 4/2009 | Li et al. | |
| 7,918,542 | B2 * | 4/2011 | Sakashita et al. | 347/68 |
| 2009/0231395 | A1 * | 9/2009 | Tsukamoto | 347/70 |

FOREIGN PATENT DOCUMENTS

| | | |
|---|---|---|
| CN | 1841805 | 10/2006 |
| JP | 2003-127366 | 5/2003 |
| JP | 2008-159735 | 7/2008 |
| WO | 02/29129 A1 | 4/2002 |

* cited by examiner

*Primary Examiner* — Matthew Luu
*Assistant Examiner* — Lisa M Solomon
(74) *Attorney, Agent, or Firm* — Workman Nydegger

(57) ABSTRACT

A liquid-ejecting head including a pressure-generating chamber communicating with an nozzle, and a piezoelectric element having a first electrode, a piezoelectric layer arranged above the first electrode, and a second electrode arranged above the piezoelectric layer. An internal electric field in the piezoelectric layer is biased toward the first electrode or the second electrode and no voltage is applied to the first electrode or the second electrode.

8 Claims, 6 Drawing Sheets

LIQUID-EJECTING HEAD, LIQUID-EJECTING APPARATUS AND ACTUATOR DEVICE

The entire disclosure of Japanese Patent Application No. 2008-264651, filed Oct. 10, 2008 is expressly incorporated herein by reference.

BACKGROUND OF THE INVENTION

1. Technical Field

The present invention relates to a liquid-ejecting head configured to eject a liquid from a nozzle opening. More particularly, the present invention relates to a liquid ejecting head, a liquid-ejecting apparatus, and an actuator device.

2. Related Art

An example of a piezoelectric element currently used in the art for use in, for example, liquid-ejecting heads, includes a piezoelectric layer composed of a piezoelectric material, such as a crystallized dielectric material, exhibiting the function of electromechanical transduction, which is arranged between a plurality of electrodes. One example of a liquid-ejecting head is an ink-jet recording head that includes, for example, a vibrating plate partially constituting a pressure-generating chamber which communicates with a nozzle opening configured to eject ink droplets. The ink-jet recording head ejects ink droplets from the nozzle opening by deforming the vibrating plate using the piezoelectric element, causing the ink in the pressure-generating chamber to become pressurized. One example of such an ink=jet recording head is disclosed in JP-A-2003-127366, which includes piezoelectric elements mounted on an ink-jet recording head which are produced by forming a uniform piezoelectric material layer over the entire surface of a vibrating plate by a film-formation technique and then processing the piezoelectric material layer to form a pattern corresponding to pressure-generating chambers by lithography, forming separate piezoelectric elements for each of the pressure-generating chambers.

With the current state of the art, however, even when a piezoelectric element including such a piezoelectric layer is formed on the pressure chamber, it is impossible to obtain a large amount of displacement at an adequate voltage or at a low voltage. Furthermore, these problems are not limited to liquid-ejecting heads such as ink-jet recording heads but are present in actuator devices for use in other apparatuses.

BRIEF SUMMARY OF THE INVENTION

An advantage of some aspects of the invention is that it provides a liquid-ejecting head having high displacement characteristics, a liquid-ejecting apparatus, and an actuator device.

A first aspect of the invention is liquid-ejecting head including a pressure-generating chamber communicating with an nozzle opening and a piezoelectric element having a first electrode, a piezoelectric layer arranged over the first electrode, and a second electrode arranged over the piezoelectric layer. An internal electric field in the piezoelectric layer is biased toward the first electrode side or the second electrode side and no voltage is applied to the first electrode or the second electrode.

In this case, the internal electric field is specified, so that a large amount of displacement of the piezoelectric element can be obtained at a low driving voltage. That is, displacement characteristics can be improved, thereby improving liquid ejection characteristics.

A second aspect of the invention is a liquid-ejecting head including a pressure-generating chamber communicating with an nozzle opening and a piezoelectric element having a first electrode, a piezoelectric layer arranged over the first electrode, and a second electrode arranged over the piezoelectric layer. The residual dielectric polarization moment in the piezoelectric layer is biased toward the first electrode or the second electrode.

In this case, the residual dielectric moment is specified, so that a large amount of displacement of the piezoelectric element can be obtained at a low driving voltage. That is, displacement characteristics can be improved, thereby improving liquid ejection characteristics.

A third aspect of the invention is an actuator device comprising a first electrode, a piezoelectric layer arranged over the first electrode, and a second electrode arranged over the piezoelectric layer. An internal electric field in the piezoelectric layer is biased toward the first electrode or the second electrode and no voltage is applied to the first electrode or the second electrode.

In this case, the internal electric field is specified, so that a large amount of displacement of the piezoelectric element can be obtained at a low driving voltage. That is, it is possible to improve displacement characteristics.

A fourth aspect of the invention is an actuator device comprising first electrode, a piezoelectric layer arranged over the first electrode, and a second electrode arranged over the piezoelectric layer. The residual dielectric polarization moment in the piezoelectric layer is biased toward the first electrode or the second electrode.

In this case, the residual dielectric polarization moment is specified, so that a large amount of displacement of the piezoelectric element can be obtained at a low driving voltage. That is, it is possible to improve displacement characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail below with reference to embodiments.

First Embodiment

Figure 1:
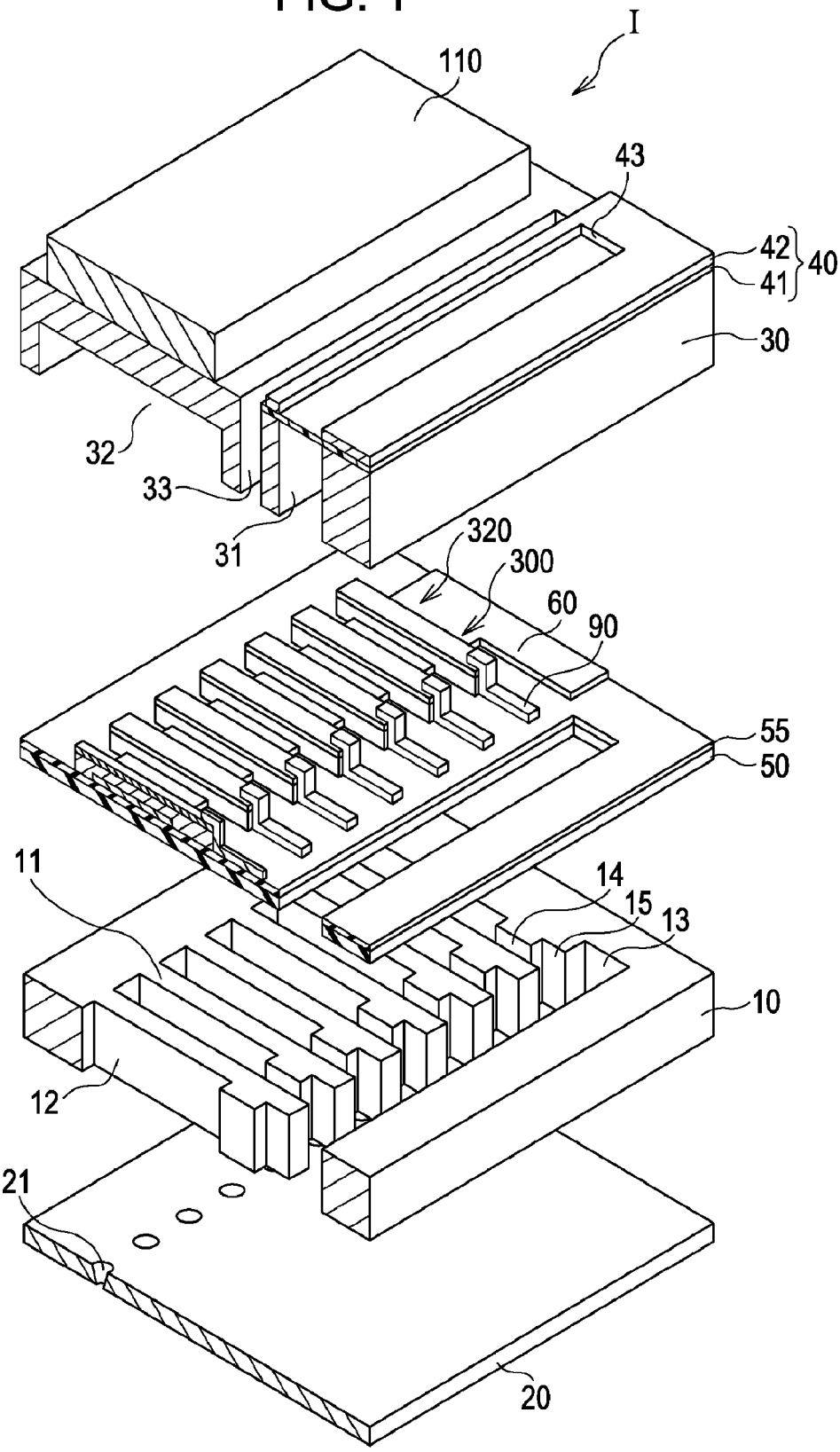
FIG. 1 is a schematic exploded perspective view of a recording head according to a first embodiment of the invention.
Figure 2A:
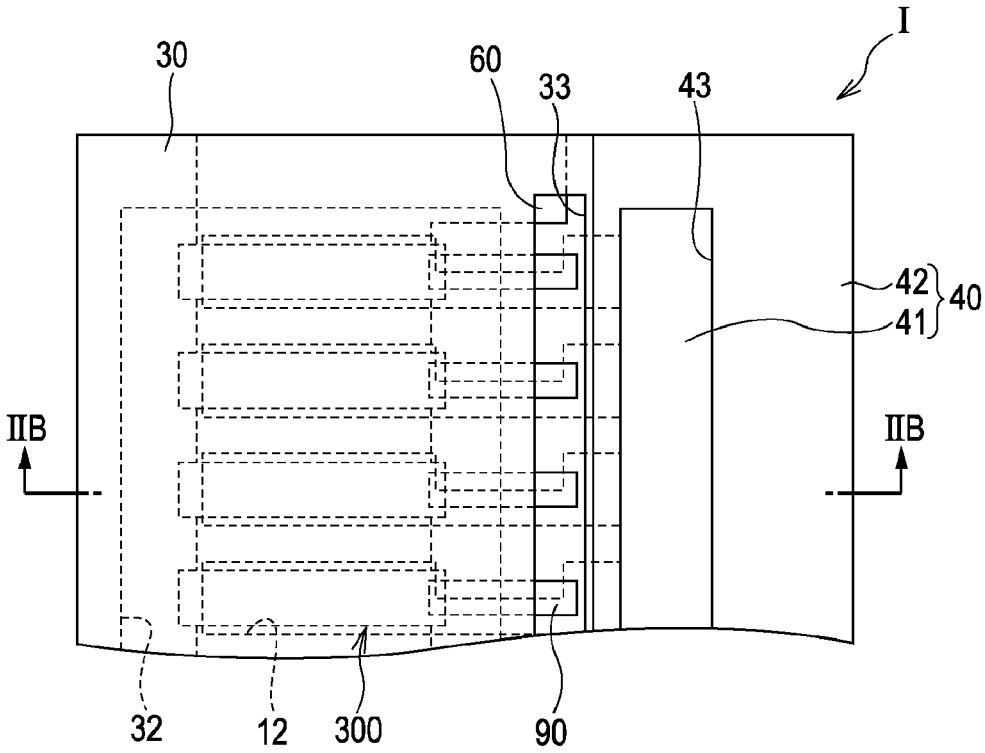
FIGS. 2A and 2B are a plan view and a cross-sectional view, respectively, of the recording head according to the first embodiment of the invention.
Figure 2B:
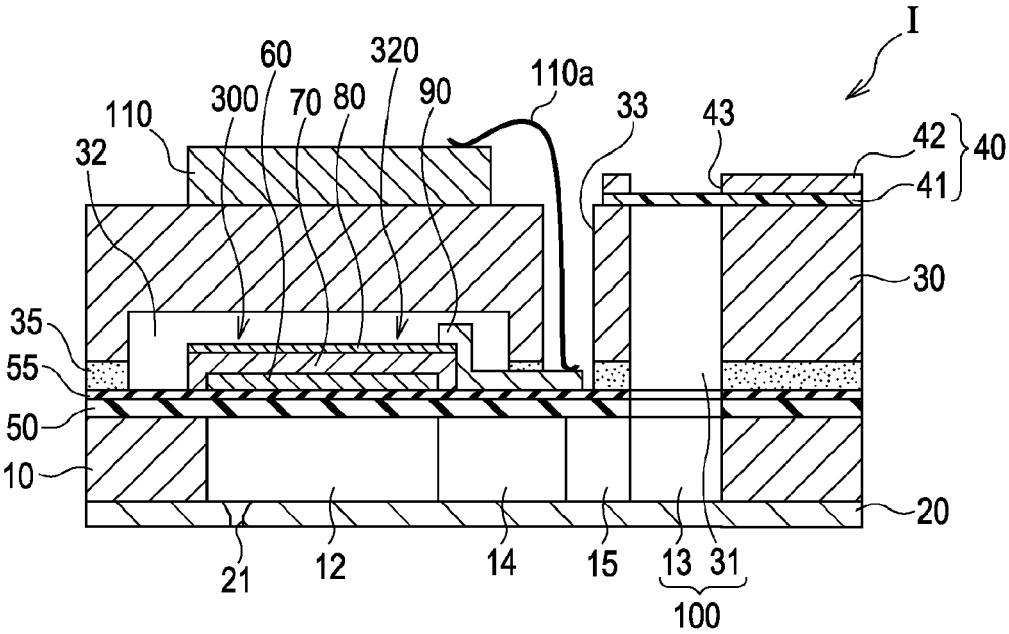

FIG. 1 is a schematic exploded perspective view of an ink-jet recording head, which serves as an example of a liquid-ejecting head according to a first embodiment of the invention. FIG. 2A is a plan view of the ink-jet recording head shown in FIG. 1. FIG. 2B is a cross-sectional view taken along line IIB-IIB in FIG. 2A.

As shown in the figures, a passage-forming substrate 10 according to this embodiment is made of a single-crystal silicon substrate. A resilient film 50 composed of silicon dioxide is arranged on one surface of the passage-forming substrate 10.

The passage-forming substrate 10 includes plurality of pressure-generating chambers 12 which are arranged in the width direction of the pressure-generating substrate 10. The passage-forming substrate 10 includes a communication portion 13 formed outside the pressure-generating chambers 12 in the longitudinal direction. The communication portion 13 communicates with the pressure-generating chambers 12 through ink feed channels 14 and communication channels 15 which communicate with the respective pressure-generating chambers 12. The communication portion 13 communicates with a reservoir portion 31, described below, and partially constitutes a reservoir which serves as a common ink chamber for the pressure-generating chambers 12. The ink feed channels 14 each have a width which is smaller than the pressure-generating chambers 12 so as to maintain ink-flow resistance at a predetermined level. The ink flows from the communication portion 13 into the pressure-generating chambers 12. In this embodiment, the width of the flow passage is reduced at one side to form the ink feed channels 14. Alternatively, the width of the flow passage may be reduced at both sides to form the ink feed channels. Furthermore, the flow passage may not be reduced in the width direction but may be reduced in the thickness direction so as to form the ink feed channels.

That is, in this embodiment, the passage-forming substrate 10 includes a liquid flow passage formed of the pressure-generating chambers 12, the communication portion 13, the ink feed channels 14, and the communication channels 15.

A nozzle plate 20 having nozzle openings 21 is bonded to an opening side of the passage-forming substrate 10 using, for example, an adhesive or a heat-sealing film, each of the nozzle openings 21 communicating with portion in the vicinity of an end of a corresponding pressure-generating chamber 12 in an area which is located away from the ink feed channels 14. The nozzle plate 20 is composed of, for example, a glass ceramic material, single-crystal silicon, or stainless steel.

The resilient film 50 is arranged on a side of the passage-forming substrate 10 opposite the opening side where the nozzle plate 20 is disposed. The resilient film 50 is overlaid with an insulating film 55. Piezoelectric elements 300 are formed on the insulating film 55, each of the piezoelectric elements 300 including a first electrode 60, a piezoelectric layer 70, and a second electrode 80, which are stacked. Here, each of the piezoelectric elements 300 indicates a portion including the first electrode 60, the piezoelectric layer 70, and the second electrode 80. Typically, one of the electrodes of each piezoelectric element 300 is used as a common electrode. The other electrode and a corresponding one of the piezoelectric layers 70 are formed by patterning for each pressure-generating chamber 12. In this embodiment, the first electrode 60 is used as the common electrode for the piezoelectric elements 300, the second electrodes 80 are used as individual electrodes for the piezoelectric elements 300. Alternatively, a reverse arrangement may be used depending on the driving circuit and interconnections without any problems and without departing from the scope of the invention. In this embodiment, portions each including each of the piezoelectric elements 300 and a vibrating plate displaced by operation of the corresponding piezoelectric element 300 are referred to as "actuator devices". While the resilient film 50, the insulating film 55, and the first electrode 60 serve as the vibrating plate in this embodiment, the invention is not limited thereto. For example, the first electrode 60 alone may serve as the vibrating plate without the resilient film 50 and the insulating film 55. Alternatively, each piezoelectric element 300 may serve substantially as the vibrating plate.

The piezoelectric layers 70 are crystalline films composed of a piezoelectric oxide material which is represented by a general formula $ABO_3$ which have a perovskite structure and a polarization structure arranged on the first electrode 60. The piezoelectric layer 70 is preferably composed of, for example, a ferroelectric material, such as lead zirconate titanate (PZT), or a ferroelectric material doped with a metal oxide, such as niobium oxide, nickel oxide, or magnesium oxide. Specific examples thereof lead titanate ($PbTiO_3$), lead zirconate titanate ($Pb(Zr,Ti)O_3$), lead zirconate ($PbZrO_3$), lead lanthanum titanate ($(Pb,La)TiO_3$), lead lanthanum zirconate titanate ($(Pb,La)(Zr,Ti)O_3$), and lead magnesium niobate zirconate titanate ($Pb(Zr,Ti)(Mg,Nb)O_3$). In this embodiment, the piezoelectric layer 70 is composed of $Pb(Zr_xTi_{1-x})O_3$ (PZT), wherein x represents 0.5.

The piezoelectric layer 70 is preferentially oriented in a [100] direction in a pseudo-cubic system. The piezoelectric layer 70 belongs to a monoclinic crystal system. The crystal structure of the piezoelectric layer 70 varies depending on production conditions. In the case of the piezoelectric layer 70 having a thickness of 5 μm or less, for example, when x is in the range of about 0.45 to about 0.55, the crystal structure of the piezoelectric layer 70 is monoclinic. In the invention, the expression "the piezoelectric layer 70 is preferentially oriented in a [100] direction" includes embodiments where all crystal grains are oriented in the [100] direction and the case where most of crystal grains (for example, 90% or more) are oriented in the [100] direction. Furthermore, in the invention, the expression "the crystal structure of the piezoelectric layer 70 is monoclinic" includes embodiments where the crystal structure of all crystal grains is monoclinic and embodiments where the crystal structure of most of crystal grains (for example, 90% or more) is monoclinic and where the crystal structure of the remaining crystal grains that are not monoclinic are tetragonal, or the like.

In the piezoelectric layer 70, the direction of a polarization moment is inclined at a predetermined angle with respect to a direction perpendicular to the layer surface (the thickness direction of the piezoelectric layer 70).

An internal electric field in the piezoelectric layer 70 is biased toward either the first electrode 60 or the second electrode 80 side. This expression is used to indicate a state in which when no voltage is applied to the first electrode 60 or the second electrode 80, where a component of the internal electric field pointing toward the first electrode 60 is not equal to a component of the internal electric field pointing toward the second electrode 80 in the direction perpendicular to the layer surface (the thickness direction of the piezoelectric layer 70). Thus, the absolute value of one component is larger than that of the other component. The direction perpendicular to the layer surface of the internal electric field is equal to the direction of arrangement of the first electrode 60 and the second electrode 80 and the direction of an electric field generated by applying a voltage from the outside. In this embodiment, the direction perpendicular to the layer surface is referred to as the "z direction" (see FIG. 3).

When the polarity of a voltage applied to the piezoelectric layer 70 through the electrodes is reversed, polarization moments are reversed. In this embodiment, they are not top-bottom symmetric. That is, the absolute value of the component in the z direction of the polarization moment pointing upward is different from that of the polarization moment pointing downward. In this case, measured values of the polarization moments are values when no voltage is applied to the first electrode 60 or the second electrode 80. Thus, the values of the polarization moments are also referred to as "residual dielectric polarization moments." The residual dielectric polarization moments can be determined from a P-V hysteresis loop obtained by electrical measurement, wherein P represents an electric flux density, and V represents a voltage.

Figure 3:
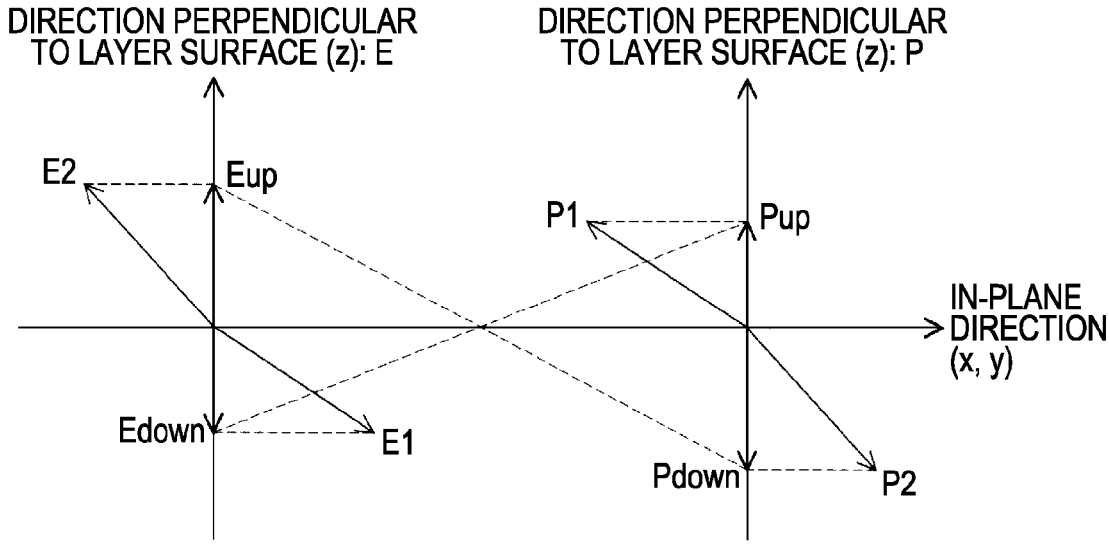
FIG. 3 shows graphs showing an internal electric field and a polarization moment according to the first embodiment of the invention.

As shown in FIG. 3, in this embodiment, when the polarization moments of the piezoelectric layer 70 are indicated by P1 and P2, a residual dielectric polarization moment $P_{up}$ of P1 in the z direction is different from a residual dielectric polarization moment $P_{down}$ of P2 in the z direction. The direction of each of the polarization moments P1 and P2 is a direction from a negative charge to a positive charge. The components $E_{up}$ and $E_{down}$ in the z direction of internal electric fields E1 and E2 generated by the polarization moments P1 and P2 are also different. In this embodiment, $P_{down}$ is larger than $P_{up}$. $E_{up}$ is also larger than $E_{down}$. That is, when the polarization moment in the z direction is biased toward the bottom of FIG. 3, the internal electric field in the z direction is biased toward the top of FIG. 3. In other words, the polarization moment in the piezoelectric layer 70 is biased toward the first electrode 60 side. The internal electric field is biased toward the second electrode 80 side.

The bias of the polarization moments P1 and P2 can be adjusted by the composition ratio and the lattice constant of the piezoelectric layer 70, the presence or absence of an oxygen deficient sublayer, and the thickness of the oxygen deficient sublayer. In the case of the piezoelectric layer 70 composed of PZT, examples of the composition ratio of the piezoelectric layer 70 include the proportion of lead (Pb) with respect to titanium and zirconium; and the ratio of titanium (Ti) to zirconium (Zr).

The bias of the polarization moment by the lattice constant of the piezoelectric layer 70 is adjusted by changing the lattice constant of the piezoelectric layer 70 so as to adjust the direction of the polarization moment. In the case where the first electrode 60 is composed of, for example, lanthanum nickelate (LNO), the piezoelectric layer 70 has a reduced lattice constant in the in-plane direction is formed because the lattice constant of LNO in the in-plane direction is smaller than that of the typical piezoelectric layer 70 in the in-plane direction. In this way, the lattice constant of the piezoelectric layer 70 in the in-plane direction is increased or reduced depending on a material of an underlying layer. Such an increase or reduction in lattice constant can shift the direction of the polarization moment. Furthermore, the lattice constant of the piezoelectric layer 70 varies depending on conditions of the formation of the piezoelectric layer 70. Examples of the conditions of the formation of the piezoelectric layer 70 include a temperature, time, and humidity during firing. A change in the direction of the polarization moment can result in a change in magnitude of the polarization moment in the z direction, thereby biasing the polarization moment toward the upper side or lower side (the first electrode 60 side or second electrode 80 side) in the z direction.

Figure 4:
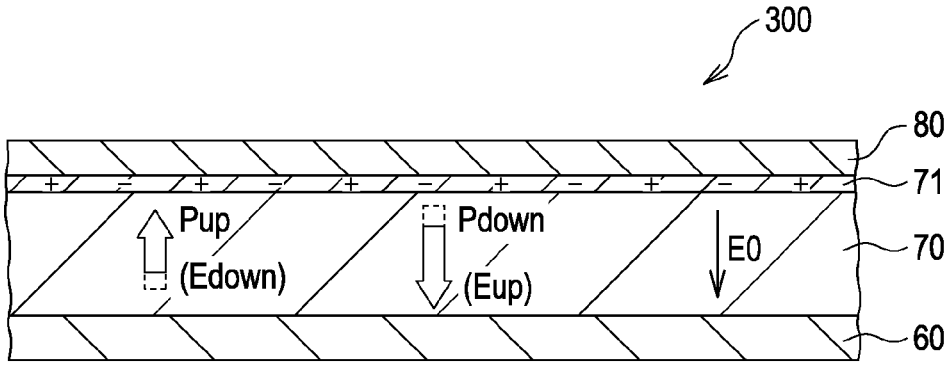
FIG. 4 is a cross-sectional view illustrating the internal electric field and the polarization moment according to the first embodiment of the invention.

The bias of the polarization moment by the presence or absence of the oxygen deficient sublayer and the thickness of the oxygen deficient sublayer on the piezoelectric layer 70 is achieved as follows: where an oxygen deficient sublayer 71 is arranged in a portion of the piezoelectric layer 70 adjacent to the second electrode 80 as shown in FIG. 4, the oxygen deficient sublayer serves as a sublayer containing an atom having a valence of +2. An effective internal electric field E0 is always applied in the direction from the second electrode 80 to the first electrode 60. The application of the effective internal electric field E0 rotates the polarization moment, which can bias the direction of the polarization moment toward the first electrode 60 side. That is, the magnitude of the z-axis component $P_{up}$ of the polarization moment P1 pointing toward the second electrode 80 side is reduced by the internal electric field E0 pointing toward the first electrode 60 side. Meanwhile, the magnitude of the z-axis component $P_{down}$ of the polarization moment P2 pointing toward the first electrode 60 side is increased by the internal electric field E0 pointing toward the first electrode 60. In this way, the direction of the polarization moment can be adjusted by the presence or absence of the oxygen deficient sublayer 71 and the strength of the internal electric field due to the oxygen deficient sublayer 71.

That is, the internal electric field in the piezoelectric layer 70 is defined as the total of, for example, the internal electric field E0 due to the oxygen deficient sublayer 71 and an internal electric field due to the polarization moment biased by the influence of the internal electric field E0. In this embodiment, the internal electric field E0 pointing toward the first electrode 60 is induced by the oxygen deficient sublayer 71. With respect to the internal electric field components $E_{up}$ and $E_{down}$ generated by the polarization moments, $E_{up}$ is greater than $E_{down}$, so that the internal electric field generated by the polarization moments is biased toward the second electrode 80. Thus, the absolute value of the total of the internal electric field E0 due to the oxygen deficient sublayer 71 and the internal electric field component $E_{down}$ due to the polarization moment, the internal electric field E0 and the internal electric field component $E_{down}$ pointing toward the first electrode 60, is different from the absolute value of the internal electric field component $E_{up}$, so that the internal electric field is biased upward or downward. As described above, however, the bias of the polarization moment can also be adjusted by factors, such as the compositional ratio and the lattice constant of the piezoelectric layer 70, as well as the influence of the internal electric field E0 due to the oxygen deficient sublayer 71.

The internal electric field in the piezoelectric layer 70 can be measured by a transmission electron microscope (TEM) by measuring the phase of an electron beam using the transport-of-intensity equation and measuring an electric field on the basis of the phase measurement.

Specifically, during the measurement process, bright-field TEM images (images formed from transmitted waves only) are utilized. Three images, i.e., including an in-focus, under-focused, and over-focused images, are prepared, where the same defocus distance on either side of the in-focus position is used. The differentiation of intensity in the direction of propagation is approximated by the difference of observed intensities (transport-of-intensity equation) to determine the phase. The phase is differentiated to determine an electric-field vector.

The electric-field vector, which is the direction of the vector of the internal electric field, is antiparallel to the direction of the vector of the polarization moment. Thus, by measuring the electric-field vector of the piezoelectric layer 70, the direction of the polarization moment of the piezoelectric layer 70 can be determined.

The absolute value of the internal electric field is proportional to the absolute value of the polarization moment. Thus, by performing a relative comparison of the absolute values of the internal electric fields, a relative comparison of the absolute values of the polarization moments can be performed.

Here, where the internal electric field E0 generated by the oxygen deficient sublayer 71 is sufficiently small, the internal electric field E0 generated by the oxygen deficient sublayer 71 may be negligible. The direction and magnitude of the internal electric field determined by this measurement method may correspond approximately to the direction and magnitude of the polarization moment, where the direction is opposite to the direction of the internal electric field.

As described above, the bias of the internal electric field in the piezoelectric layer 70 may result in the improvement of the displacement characteristics of the piezoelectric layer 70.

With respect to the thickness of the piezoelectric layer 70, the thickness is suppressed so that no cracking occurs during the production process, while the thickness is adequate so that that sufficient displacement characteristics are provided. For example, in this embodiment, the piezoelectric layer 70 is formed so as to have a thickness of about 1 to about 2 μm.

The production process of the piezoelectric layer 70 is not particularly limited, and a variety of processes known in the art may be used without departing from the scope of the invention. For example, the piezoelectric layer 70 can be formed by a sol-gel method including applying of a sol prepared by dissolving or dispersing an organometallic compound in a solvent, converting the sol into a gel by drying, and firing the gel at a high temperature to form a metal oxide. Despite this example, however, the production process of the piezoelectric layer 70 is not limited to the sol-gel method. For example, metal-organic decomposition (MOD) or sputtering may be employed.

EXAMPLES

Example 1

In a first example, the piezoelectric element 300, including the piezoelectric layer 70 where the internal electric field was biased by adjusting the thickness of the oxygen deficient sublayer 71 in the piezoelectric layer 70, was formed by a sol-gel method. Specifically, the 1000-nm-thick resilient film 50 composed of silicon dioxide ($SiO_2$) was formed on the passage-forming substrate 10 formed of a single-crystal silicon (100) substrate. The 500-nm-thick insulating film 55 composed of zirconium oxide ($ZrO_2$) was formed on the resilient film 50. Platinum (Pt) and Iridium (Ir) were successively deposited by sputtering on the insulating film 55 to form the first electrode 60 having a thickness of 200 nm. A process including applying a precursor liquid to form the piezoelectric layer 70 on the first electrode 60, drying the applied precursor, heating the dry piezoelectric precursor film to the extent that the piezoelectric precursor film was not crystallized, and firing the calcined piezoelectric precursor film, was repeated for each application of the precursor liquid in order to form a film having a thickness of 200 nm, thereby forming the piezoelectric layer 70 having a thickness of 1.1 μm. In each firing step, heating at 780° C. for 30 seconds in an atmosphere containing 20% oxygen was repeated three times. The 200-nm-thick second electrode 80 composed of iridium (Ir) was formed on the piezoelectric layer 70 by sputtering.

Example 2

The same structure and production process as in the first example were used, except that in the firing step of firing the piezoelectric layer 70, heating at 700° C. for 60 seconds in an atmosphere containing 100% oxygen was performed once.

Test Results

A relative comparison was made between amounts of oxygen in portions of the piezoelectric layers 70 adjacent to the second electrodes 80 in the first and second example using an energy dispersive X-ray fluorescence spectrometer (EDX). The deficient amounts of oxygen were compared at a specific position X in each piezoelectric layer 70 50 nm apart from the interface between the piezoelectric layer 70 and the corresponding second electrode 80. The position X is a position at which the composition of the second electrode side is measured. The amount of oxygen in the middle of the piezoelectric layer 70 in the thickness direction is defined as a reference (1.0). The signal strength of the amount of oxygen at the position X is defined as a signal strength $O_x$. A relative comparison of the signal strengths $O_x$ was made between the first and second examples. Specifically, Table 1 shows the relative signal strength $O_x$ in Example 1 when the signal strength $O_x$ in Example 2 is defined as 100%.

With respect to each of the piezoelectric layers 70 in Example 1 and Example 2, the phase of an electron beam was measured with a transmission electron microscope using the transport-of-intensity equation. An electric field was measured on the basis of the phase measurement. Thereby, components of the internal electric field and the polarization moment in the z direction (residual dielectric polarization moment) were determined.

Furthermore, with respect to each of the piezoelectric layers 70 in Example 1 and Example 2, the lattice constant in the in-plane direction (a axis) and the lattice constant in the thickness direction (b axis) of the piezoelectric layer 70 were measured. These lattice constants were determined from diffraction peaks obtained by X-ray diffraction (XRD).

With respect to each of the piezoelectric elements 300 in Example 1 and Example 2, a rectangular wave having an upper limit of 30 V, a lower limit voltage of −2 V, and a frequency of 50 kHz was applied to measure the amount of displacement of the piezoelectric element 300 with a laser displacement gauge. Table 1 shows these results.

TABLE 1

| | Example 1 | Example 2 |
|---|---|---|
| Amount of oxygen at surface | 95% | 100% |
| Internal electric field $E_{up_total}$ | 120 kV/cm | 125 kV/cm |
| Internal electric field $E_{down_total}$ | 100 kV/cm | 125 kV/cm |
| Residual dielectric polarization moment $P_{down}$ | 15 μC/cm$^2$ | 15 μC/cm$^2$ |
| Residual dielectric polarization moment $P_{up}$ | 12 μC/cm$^2$ | 15 μC/cm$^2$ |
| a-axis lattice constant | 0.418 nm | 0.418 nm |
| b-axis lattice constant | 0.415 nm | 0.415 nm |
| Amount of piezoelectric displacement | 430 nm | 400 nm |

As shown in Table 1, in the piezoelectric layer 70 in Example 1, the amount of oxygen on the second electrode 80 side was small, or the deficiency of the oxygen was large. In contrast, in the piezoelectric layer 70 in Example 2, an even amount of oxygen was distributed in the thickness direction.

Since the piezoelectric layer 70 in Example 1 includes the oxygen deficient sublayer 71, the internal electric field $E_{up_total}$ was larger than the internal electric field $E_{down_total}$. That is, the internal electric field was biased toward the second electrode 80 side. In contrast, in the piezoelectric layer 70 in Example 2, the internal electric field $E_{up_total}$ was equal to the internal electric field $E_{down_total}$. That is, the internal electric field was not biased toward either the first electrode 60 side or the second electrode 80 side. In the piezoelectric layer 70 in Example 1, the magnitude of the polarization moment $P_{down}$ was larger than the magnitude of the polarization moment $P_{up}$. That is, the polarization moment was biased toward the first electrode 60. In contrast, in the piezoelectric layer 70 in Example 2, the magnitude of the polarization moment $P_{down}$ was equal to the magnitude of the polarization moment $P_{up}$. That is, the magnitude of the polarization moment was not biased toward either the first electrode 60 or the second electrode 80.

In Example 1, the piezoelectric element 300 including the piezoelectric layer 70 in which the internal electric field was biased toward the second electrode 80, the amount of displacement was measured as 430 nm, which was larger than in Example 2.

A factor in this phenomenon seems to be the fact that the pinning of the polarization moment suppresses a reduction in the amount of displacement of the piezoelectric element 300. When a voltage is applied to the piezoelectric element 300, the polarization moment in the z direction points to the direction of the vector of the applied voltage in the almost entire region of the piezoelectric layer 70 at the upper-limit voltage. When the applied voltage is reduced to about 0 V, polarization reversal begins to occur in part of the piezoelectric layer 70 by a depolarization field in the piezoelectric layer 70. Then the polarization moment may be reversed and set in a direction opposite to the applied voltage. The anomalous reversal region functions to reduce the piezoelectric displacement. As shown in Example 1, where the magnitude of the polarization moment is biased toward one side in advance, the magnetization of the polarization moment set in the region in the opposite direction can be reduced, thus suppressing a reduction in piezoelectric displacement. Thereby, a large amount of displacement can be obtained.

That is, the bias of the internal electric field in the piezoelectric layer 70 toward the first electrode 60 or the second electrode 80 results in excellent displacement characteristics. In other words, it is possible to obtain a large amount of displacement at a low driving voltage.

In Example 1 and Example 2, the same a-axis lattice constant and the same b-axis lattice constant are used. Thus, there is no change in the direction of the internal electric field due to the lattice constant and the compositional ratio. The direction of the internal electric field is changed by the presence or absence of the oxygen deficient sublayer 71 and the thickness. Of course, the direction of the internal electric field may also be changed by adjusting the compositional ratio, the lattice constant, and a combination of these parameters without limitation.

The second electrodes 80 are each composed of, for example, iridium (Ir) and each have a thickness of 200 nm. The second electrodes 80 function as individual electrodes for the piezoelectric elements 300. Furthermore, the second electrodes 80 are connected to respective lead electrodes 90 composed of, for example, gold (Au), the lead electrodes 90 extending from ends of the second electrodes 80 adjacent to the respective ink supply channels 14 to a surface of the insulating film 55.

A protective substrate 30, including the reservoir portion 31 at least partially constituting a reservoir 100, is bonded to the passage-forming substrate 10 provided with the piezoelectric elements 300, i.e., to the first electrode 60, the insulating film 55, and the lead electrodes 90, with an adhesive 35. In this embodiment, the reservoir portion 31 passes through the protective substrate 30 in the thickness direction and is arranged in the width direction of the pressure-generating chambers 12. As described above, the reservoir portion 31 communicates with the communication portion 13 of the passage-forming substrate 10 to form the reservoir 100 which serves as a common ink chamber for the pressure-generating chambers 12. Furthermore, the communication portion 13 in the passage-forming substrate 10 may be divided into sections for respective pressure-generating chambers 12, and the reservoir portion 31 alone may serve as a reservoir. Moreover, for example, the passage-forming substrate 10 may be provided with only the pressure-generating chambers 12, and the reservoir 100 and the ink feed channels 14 communicating with the respective pressure-generating chambers 12 may be arranged in a different component disposed between the passage-forming substrate 10 and the protective substrate 30, such as, for example, the resilient film 50 and the insulating film 55.

A piezoelectric-element-enclosing portion 32 has a cavity formed therein so that the motion of the piezoelectric elements 300 is not inhibited. The piezoelectric-element-enclosing portion 32 is formed in a region of the protective substrate 30 facing the piezoelectric elements 300. The cavity may or may not be sealed.

The protective substrate 30 is preferably composed of a material, such as glass or a ceramic material, having substantially the same thermal expansion coefficient as that of the passage-forming substrate 10. In this embodiment, the protective substrate 30 is composed of a single-crystal silicon, which is the same material that constitutes the passage-forming substrate 10.

The protective substrate 30 is provided with a through hole 33 passing through the protective substrate 30 in the thickness direction. Each of the lead electrodes 90 extending from a corresponding one of the piezoelectric elements 300 has an end portion exposed in the through hole 33.

A driving circuit 110 that operates the piezoelectric elements 300 arranged in parallel is fixed on the protective substrate 30. For example, a circuit board or a semiconductor integrated circuit (IC) may be used as the driving circuit 110. The driving circuit 110 is electrically connected to the lead electrodes 90 through interconnections **110*a*** formed of conductive wires such as bonding wires.

A compliance substrate 40 including a seal film 41 and a stationary plate 42 is bonded to the protective substrate 30. The seal film 41 is composed of a material having flexibility and a low stiffness. An end of the reservoir portion 31 is sealed with the seal film 41. The stationary plate 42 is composed of a relatively rigid material. A region of the stationary plate 42 opposite the reservoir 100 is completely removed in the thickness direction to form an opening 43. Thus, an end of the reservoir 100 is sealed solely with the flexible seal film 41.

In an ink-jet recording head according to this embodiment, ink is fed from an ink port connected to an external ink-feeding unit (not shown) to fill the inside of the head with the ink, meaning that the passageways from the reservoir 100 to the nozzle openings 21 are filled with ink. Then a voltage is applied between the first electrode 60 and the second electrode 80 corresponding to the pressure-generating chambers 12 according to a recording signal from the driving circuit 110 to deform the resilient film 50, the insulating film 55, the first electrode 60, and the piezoelectric layer 70, so as to increase the pressure in the pressure-generating chambers 12 and cause ink droplets to be ejected from the nozzle openings 21.

Other Embodiments

While the invention is described above using examples, the basic structure of the invention is not limited to the foregoing embodiment. For example, although the embodiment described above uses a single-crystal silicon substrate as the passage-forming substrate 10, the passage-forming substrate 10 is not particularly limited thereto. For example, a (100)- or (110)-oriented single-crystal silicon substrate may be used. Alternatively, for example, a SOI substrate or a glass substrate may be used.

Additionally, in the first embodiment described above the piezoelectric layer 70 in which the internal electric field is biased toward the second electrode 80 side is described. Of course, the internal electric field may be biased toward the first electrode 60 side.

Figure 5:
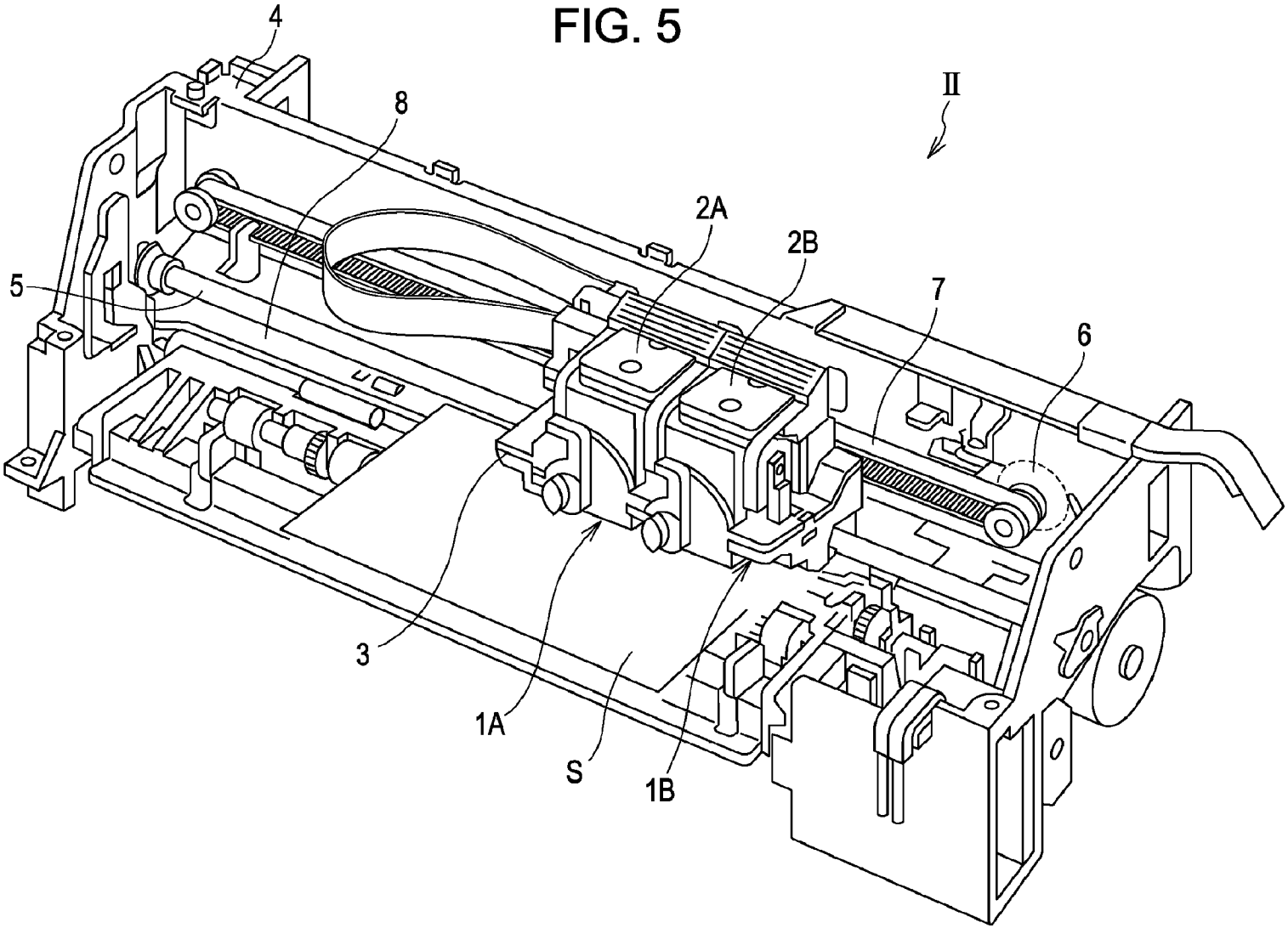
FIG. 5 is a schematic view of a recording apparatus according to one embodiment of the invention.

Furthermore, the ink-jet recording head described above may constitute a part of a recording head unit including an ink passage communicating with, for example, an ink cartridge and is mounted on an ink-jet recording apparatus. FIG. 5 is a schematic view showing an exemplary ink-jet recording apparatus.

In the ink-jet recording apparatus shown in FIG. 5, cartridges 2A and 2B each constituting an ink feed unit are detachably mounted on recording head units 1A and 1B, respectively, each including the ink-jet recording head. A carriage 3 on which the recording head units 1A and 1B are mounted is attached to a carriage shaft 5 fixed to a main body 4 so as to move in the axial direction. For example, the recording head units 1A and 1B ejects a black ink composition and a color ink composition, respectively.

The driving force of a drive motor 6 is transmitted to the carriage 3 through gears (not shown) and a timing belt 7, so that the carriage 3 on which the recording head units 1A and 1B are mounted is capable of moving along the carriage shaft 5. A platen 8 is arranged along the carriage shaft 5 in the main body 4. A recording sheet S, which is a recording medium such as paper, fed by feed rollers (not shown) and the like is transported with the platen 8.

Figure 6:
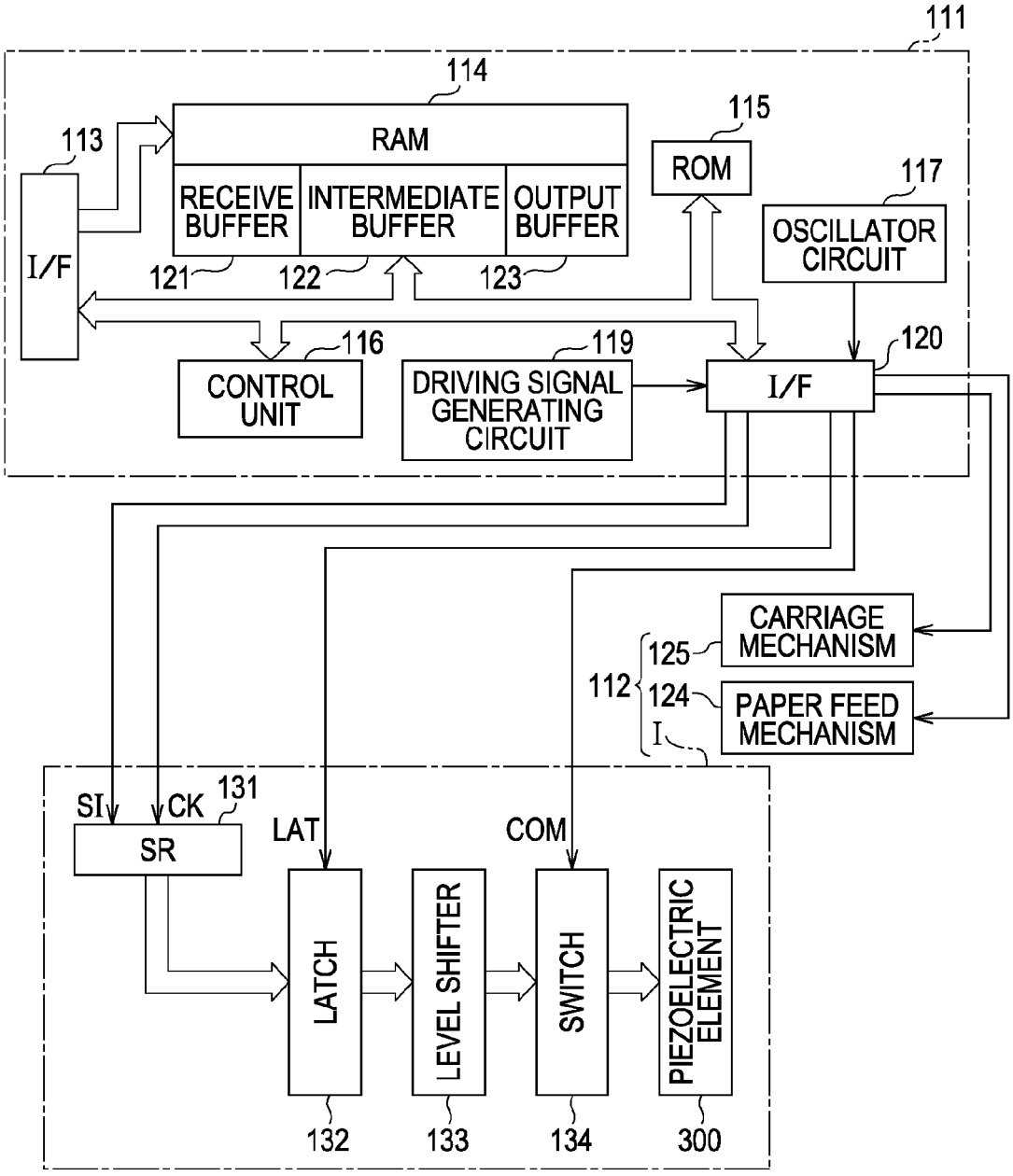
FIG. 6 is a block diagram illustrating a control structure according to one embodiment of the invention.

The ink-jet recording apparatus II also includes a driving unit (not shown). The ink-jet recording apparatus II will be described below. FIG. 6 is a block diagram illustrating a control structure in this embodiment.

As shown in FIG. 6, the ink-jet recording apparatus is generally constituted by a printer controller 111 and a print engine 112. The printer controller 111 includes a control unit 116 having, for example, an external interface 113 (hereinafter, referred to as an "external I/F 113"), RAM 114 that temporarily stores various data sets, ROM 115 that stores a control program and the like, and a CPU, an oscillator circuit 117 that generates a clock signal, a driving-signal-generating circuit 119 that generates a driving signal for the ink-jet recording head, and an internal interface 120 (hereinafter, referred to as an "internal I/F 120") that transmits, for example, dot pattern data (bitmap data) generated by a driving signal or print data to the print engine 112.

The external I/F 113 receives print data constituted by, for example, a character code, a graphic function, and image data from a host computer or the like (not shown). A busy signal (BUSY) and an acknowledgement signal (ACK) are fed into the host computer and the like through the external I/F 113. The RAM 114 functions as a receive buffer 121, an intermediate buffer 122, an output buffer 123, and work memory (not shown). The receive buffer 121 temporarily stores print data received by the external I/F 113. The intermediate buffer 122 stores intermediate code data converted by the control unit 116. The output buffer 123 stores the dot pattern data. The dot pattern data is constituted by print data obtained by decoding gray-scale data.

The driving-signal-generating circuit 119 generates a driving signal COM. The driving signal COM is a signal including an ejection pulse that drives a corresponding one of the piezoelectric elements 300 to eject ink during one recording period and is repeatedly generated for every recording period T.

The ROM 115 stores font data, a graphic function, and the like in addition to the control program or control routine that processes various data sets. The control unit 116 reads the print data in the receive buffer 121 and allows intermediate code data obtained by the conversion of the print data to be stored in the intermediate buffer 122. The intermediate code data read from the intermediate buffer 122 is analyzed. The intermediate code data is converted into dot pattern data with reference to the font data, the graphic function, and the like stored in the ROM 115. The control unit 116 performs decorative processing required and then allows the resulting dot pattern data to be stored in the output buffer 123.

When dot pattern data sets for each line for the ink-jet recording head are created, the dot pattern data are fed into the ink-jet recording head via the internal I/F 120. Furthermore, when the dot pattern data sets are fed from the output buffer 123, the converted intermediate code data is eliminated from the intermediate buffer 122. Then the subsequent intermediate code data is converted.

The print engine 112 includes the ink-jet recording head, a paper feed mechanism 124, and a carriage mechanism 125. The paper feed mechanism 124 includes a paper feed motor and the platen 8. The recording sheet S such as recording paper is successively fed in response to the recording operation of the ink-jet recording head. That is, the paper feed mechanism 124 relatively moves the recording sheet S in a subscanning direction.

The carriage mechanism 125 includes the carriage 3 on which the ink-jet recording head can be mounted and a carriage-driving member that moves the carriage 3 in a main scanning direction. The carriage mechanism 125 transfers the ink-jet recording head in the main scanning direction by moving the carriage 3. The carriage-driving member includes the drive motor 6, the timing belt 7, and the like as described above.

The ink-jet recording head includes many nozzle openings 21 along the subscanning direction and ejects droplets from the nozzle openings 21 at a timing specified by the dot pattern data and the like. Electrical signals, such as a driving signal COM and print data (SI), are fed into the piezoelectric elements 300 of the ink-jet recording head through external wiring (not shown).

In the printer controller 111 and the print engine 112 having the structure, the printer controller 111 and the driving circuit 110 serve as a driving unit that applies a predetermined driving signal to a corresponding one of the piezoelectric elements 300, the driving circuit 110 including a latch 132, a level shifter 133, a switch 134, and the like that selectively send a driving signal having a predetermined driving waveform fed from the driving-signal-generating circuit 119 into each piezoelectric element 300.

A shift resister 131, the latch 132, the level shifter 133, the switch 134, and the piezoelectric element 300 are arranged for each nozzle opening 21 of the ink-jet recording head. The shift resister 131, the latch 132, the level shifter 133, and the switch 134 form a driving pulse from a driving signal COM generated by the driving-signal-generating circuit 119. Here, the driving pulse is used to indicate a pulse actually applied to a corresponding one of the piezoelectric elements 300.

Figure 7:
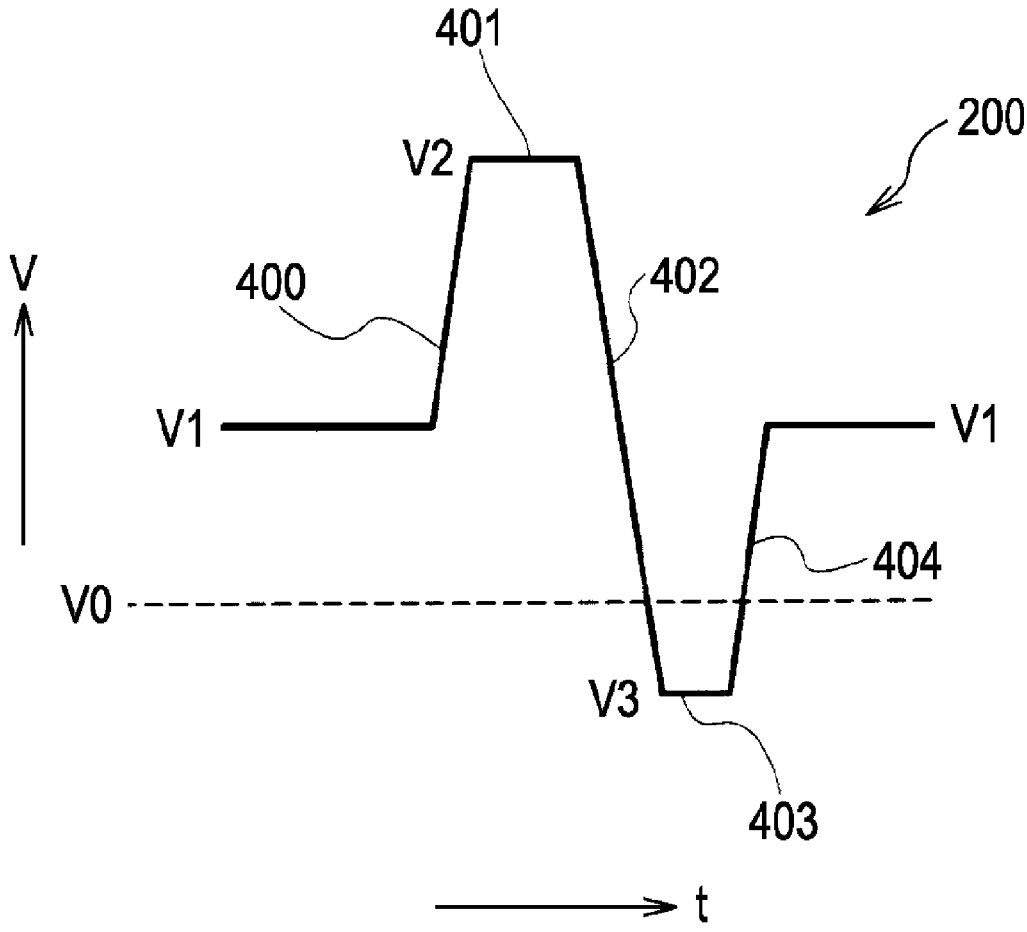
FIG. 7 is a waveform chart showing a driving pulse according to one embodiment of the invention.

FIG. 7 shows an example of the driving pulse. A driving pulse 200 is applied to the second electrode 80 when the first electrode 60 is set at a reference potential of V0 as shown in FIG. 7. The driving pulse 200 includes a contraction step 400 of increasing a driving potential V from a first potential V1, which is higher than the reference potential V0, to a second potential higher than the first potential V1 to reduce the volume of a corresponding one of the pressure-generating chambers 12, a first holding step 401 of holding the second potential V2 for a predetermined period of time, an expansion step 402 of reducing the driving potential V from the second potential V2 to a third potential V3 that is lower than the first potential V1 and the reference potential V0 to increase the volume of the pressure-generating chambers 12, a second holding step 403 of holding the third potential V3 for a predetermined period of time, and a step 404 of increasing the driving potential V from the third potential V3 to the first potential V1.

When the driving pulse 200 is fed into a corresponding one of the piezoelectric elements 300, the piezoelectric element 300 is deformed during the contraction step 400 so as to reduce the volume of the corresponding pressure-generating chamber 12, thereby generate a meniscus state of ink in a corresponding one of the nozzle openings 21. The piezoelectric element 300 is deformed during the expansion step 402 so as to increase the volume of the pressure-generating chamber 12, so that the ink in the meniscus state at the corresponding nozzle opening 21 is rapidly drawn toward the pressure-generating chamber 12 side and is thus separated to form an ink droplet. The ink droplet ejected from the nozzle opening 21 flies. That is, the driving pulse 200 is in a fill-before-fire mode.

In the first embodiment described above, an ink jet recording head is used as an example of a liquid ejecting head capable of performing aspects of the invention. The invention is directed to all liquid ejecting heads and, of course, can also be applied to liquid ejecting heads that eject liquids other than ink. Examples of other liquid ejecting heads include various recording heads used for image-recording devices such as printers; colorant ejecting heads used in the production of color filters for liquid crystal displays and the like; electrode-material ejecting heads used for forming electrodes in organic EL displays, field emission displays (FEDs), and the like; and bioorganic-material ejecting heads used for the production of biochips.

The invention is not limited to the piezoelectric element mounted on an liquid-ejecting head such as an ink-jet recording head but may be applied to a piezoelectric element mounted on another apparatuses.

What is claimed is:

1. A liquid-ejecting head comprising:

a pressure-generating chamber communicating with an nozzle opening; and a piezoelectric element having:

a first electrode, a piezoelectric layer arranged above the first electrode, wherein at least a portion of the piezoelectric layer is oxygen deficient, and a second electrode arranged above the piezoelectric layer, wherein an internal electric field in the piezoelectric layer is biased toward the first electrode side or the second electrode side and no voltage is applied to the first electrode or second electrode.

2. A liquid-ejecting head comprising:

a pressure-generating chamber communicating with an nozzle opening; and a piezoelectric element having:

a first electrode, a piezoelectric layer arranged above the first electrode, wherein at least a portion of the piezoelectric layer is oxygen deficient, and a second electrode arranged above the piezoelectric layer, wherein the residual dielectric polarization moment in the piezoelectric layer is biased toward the first electrode or the second electrode.

3. The liquid-ejecting head according to claim 1, wherein the piezoelectric layer has a perovskite structure and contains lead, zirconium, and titanium.

4. The liquid-ejecting head according to claim 1, wherein the piezoelectric layer has a monoclinic structure.

5. The liquid-ejecting head according to claim 1, wherein the piezoelectric layer is preferentially oriented in the [100] direction.

6. A liquid-ejecting apparatus comprising:

the liquid-ejecting head according to claim 1.

7. An actuator device comprising:

a first electrode, a piezoelectric layer arranged above the first electrode, wherein at least a portion of the piezoelectric layer is oxygen deficient, and a second electrode arranged above the piezoelectric layer, wherein an internal electric field in the piezoelectric layer is biased toward the first electrode or the second electrode.

8. An actuator device comprising:

a first electrode, a piezoelectric layer arranged above the first electrode, wherein at least a portion of the piezoelectric layer is oxygen deficient, and a second electrode arranged above the piezoelectric layer, wherein the residual dielectric polarization moment in the piezoelectric layer is biased toward the first electrode or the second electrode.

* * * * *